US005975520A

United States Patent [19]

Shim

[11] Patent Number: 5,975,520

[45] Date of Patent: Nov. 2, 1999

[54] EXPANDABLE CASSETTE FOR AN ELECTROPHOTOGRAPHIC DEVICE

[75] Inventor: Hyeong-Seog Shim, Yongin, Rep. of Korea

[73] Assignee: SamSung Electronics Co., Ltd., Kyungki-do, Rep. of Korea

[21] Appl. No.: 08/884,488

[22] Filed: Jun. 27, 1997

[30] Foreign Application Priority Data

Jun. 27, 1996 [KR] Rep. of Korea ..... 96-24448

[51] Int. Cl.[6] ..... B65H 1/00; B65H 1/22; B65H 31/20

[52] U.S. Cl. ..... 271/171; 271/162; 271/164; 271/145; 271/223

[58] Field of Search ..... 271/171, 162, 271/164, 145, 223

[56] References Cited

U.S. PATENT DOCUMENTS

| | | | |
|---|---|---|---|
| 4,508,447 | 4/1985 | Doery | 271/3.1 |
| 4,711,442 | 12/1987 | Runzi | 271/171 |
| 4,788,571 | 11/1988 | Ura et al. | 271/171 |
| 5,111,252 | 5/1992 | Hamada et al. | 271/171 |
| 5,156,386 | 10/1992 | Kitajima et al. | 271/3.1 |
| 5,297,787 | 3/1994 | Shirai | 271/171 |
| 5,314,177 | 5/1994 | Anma | 271/3.1 |
| 5,512,928 | 4/1996 | Kato et al. | 271/9.01 |
| 5,549,290 | 8/1996 | Long et al. | 271/171 |
| 5,565,970 | 10/1996 | Suda | 271/9.01 |
| 5,573,234 | 11/1996 | Petocchi | 271/171 |
| 5,613,672 | 3/1997 | Tanaka et al. | 271/171 |

FOREIGN PATENT DOCUMENTS

| | | | |
|---|---|---|---|
| JA0217465 | 9/1986 | Japan | 271/223 |
| 403138259 | 6/1991 | Japan | 271/223 |
| 404039258 | 2/1992 | Japan | 271/223 |

*Primary Examiner*—William E. Terrell
*Assistant Examiner*—Wonki Park

[57] ABSTRACT

An expandable cassette for use with device to support a sheet that is fed into from a communication machinery. The expandable tray may include a first tray and a second tray mounted on the first sheet support so that the second tray can be rotated around a shaft that is attached to tray in the direction that paper is discharged from the image forming device. A third tray may be slidably mounted on the second tray in such a manner that the third tray is moveable back and forth along direction that paper is discharged from the image forming apparatus.

15 Claims, 6 Drawing Sheets

EXPANDABLE CASSETTE FOR AN ELECTROPHOTOGRAPHIC DEVICE

CLAIM FOR PRIORITY

This application make reference to, incorporates the same herein and claims all benefits accruing under 35 U.S.C. §119 through my patent application entitled EXPANDABLE CASSETTE FOR AN ELECTROPHOTOGRAPHIC DEVICE earlier filed on the 27th day of Jun. 1996 in the Korean Industrial Property Office, and there regularly assigned Ser. No. 24448/1996.

BACKGROUND OF THE INVENTION

1. Field of the Invention

The present invention relates to a cassette for an image forming device used for supporting sheets fed to or sheets received from an electrophotographic apparatus (e.g. a printer, a laser beam printer, a facsimile machine, a complex image forming device, etc). In particular, the present invention relates to an expandable paper cassette.

2. Description of the Related Art

In a contemporary image forming device the sheets fed sequentially, one by one, by finger. A pick up roller loads paper from a sheet feeding tray, and transfers paper to feeding paper. Then, an image forming process occurs as the papers fed toward a sheet discharging roller. Once the sheets have passed through a sheet discharging, roller they are loaded on paper cassette. Thus, an image forming device may be designed to use one of a variety of paper cassette, also known as stackers. The dimensions of the stackers may have a great effect on the size and shape of the machinery.

Nowadays, the image forming machinery may include a folded type stacker of the size corresponding to the sheet size, conforming to a continuing trend toward miniaturized the machinery size. Furthermore, in a case of supporting the sheets fed, the stacker should be sized substantially equal to the sheet size. Thus, the general tendency of the stacker is to embody the stacker even in a smaller space than the sheet size. In a contemporary stacker, when the sheet is discharged using the machinery, the mounting space of the stacker has been minimized by the mounting of a 2 stage or 3 stage structure and forming a guide thereon, thus to "pull" and "push" (a sliding type) it However, this stacker has the problem that until the size of the stacker is equal to with, or lager that of the sheet positioned on the stacker, the stacker will not function properly. As a consequence, since the stacker has an effect on the entire size of the machinery, the substantial mounting space of the machinery should be widened. Examples of this contemporary practice are shown in Petechia (U.S. Pat. No. 5,573,234, *Dual Mode Sheet Feeder*, Nov. 12, 1996) which discusses a mode of operation in which two sheets are supported side by side. Alteratively, a single sheet feeder mounted movably in the sheet feeding apparatus may be employed to advance successive sheets from each of the stack of sheets. Suda (U.S. Pat. No. 5,565,9709, *Image Forming Apparatus*, Oct. 15, 1996) discusses a first accommodating cassette for accommodating sheets, and a second accommodating cassette arranged above the first accommodating cassette and adapted to accommodate sheets. A curl correction device causes sheets from different cassettes to bend in the same direction. Kato et al. (U.S. Pat. No. 5,512,928, Information Printing System Having Information Processing Apparatuses And Printer Including Printing Medium Cassettes, Apr. 30, 1996) discusses a printing paper cassette detachment inhibition mechanism unit inhibiting the detachment of the printing paper cassette when the printing paper in the printing paper cassette has been selected for use by one the hosts. A selected printing paper cassette display unit is provided on the laser beam printer and displays the selected printing paper cassette. Amman (U.S. Pat. No. 5,314,177, Sheet Stacking Apparatus, May 24, 1994) discusses a sheet stacking apparatus having a shutter mechanism. When these shutter downward and upward movements are repeatedly performed, stacking can be performed stably, and the sheets discharged from the lower bottom of the stacking safe can be collected in the upper portion of the stacking safe. Kitajima et al. (U.S. Pat. No. 5,156,386, Original Document Feeder, Oct. 20, 1992) discusses a document feeder with a first sheet path for guiding a document from the stacker, along wit the two other sheet paths. Docry (U.S. Pat. No. 4,508,447, Alternative Feeding Document Recirculation, Apr. 2, 1985) discusses separating the sheet of document sheets into two half-sets of alternate page document sheets, odd and even, and restacking the half-sets respectively in the two document trays. Upon the study of contemporary practice and art, I find that there is a need for an effective and improved stacking apparatus, especially the stacking apparatus with such mountings of sheet supports as in the present invention.

SUMMARY OF THE INVENTION

Thus, and object of the present invention is to provide an improved stacker for an image forming machinery used for supporting a sheet fed or a sheet to be fed from a communication machinery (e.g. a printer, a laser beam printer, a facsimile machine, a complex image forming machinery, etc).

Another object of the present invention relates is to provide an improved apparatus for feeding several sheets one by one, into an image forming device.

Another object of the present invention is to provide and improved stacker for an image forming machinery having the same effect as a contemporary stacker even in a small size in consideration of the length of width direction of the sheet.

These and the other objects may be attained by providing a cassette, or stacker, for an image forming device that is expandable. This may include a first tray and a second tray mounted on the first tray so that the second tray can be rotated around a shaft protruding from the first tray.

A third tray may be mounted on the second tray in such a manner that the third sheet support is slided back and forth in the sheet discharging direction on the stacker by a guide.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar elements components, wherein.

DETAILED DESCRIPTION OF THE PREFERRED EMBODIMENTS

Figure 1:
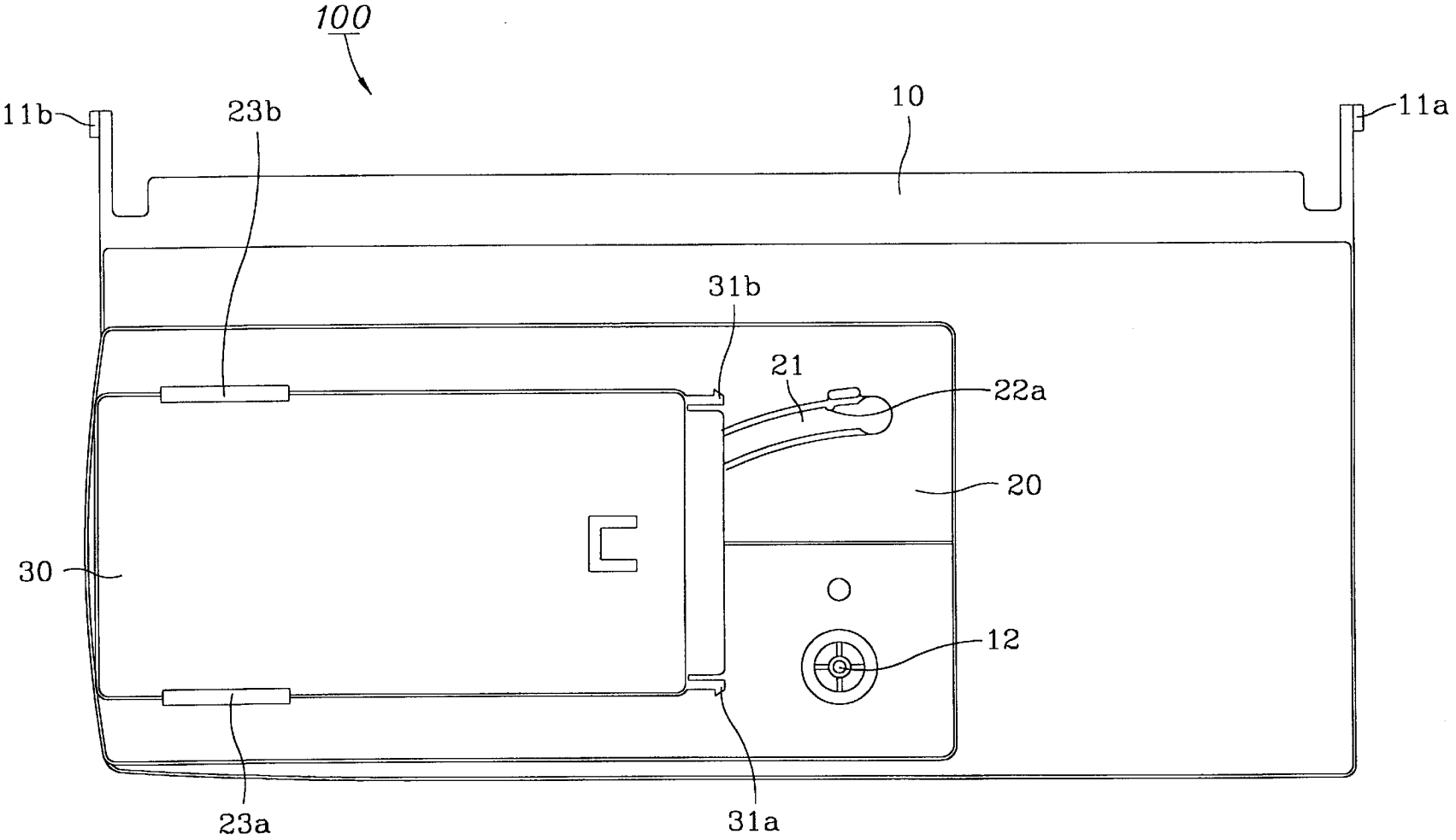
FIG. 1 is a plan view of a cassette for an image forming device in accordance with the principles of a preferred embodiment of the present invention.

Turning now to the drawings, FIG. 1 gives a plan view of cassette 100 as constructed according to a preferred embodiment of the present invention. First tray has the contour of a rectangle whose length is greater than its width. Also, second tray has the contour of a rectangle thus allowing second tray 20 to be mounted to first tray 10. As shown in FIG. 1, second tray 20 is mounted on first tray 10 in such manner that it is extendable in a longitudinal direction when second tray 10 in such a manner that it is extendable in a longitudinal direction when the second tray 20 is rotated around shaft 12 of the first tray.

Figures 2, 2A, 2B:
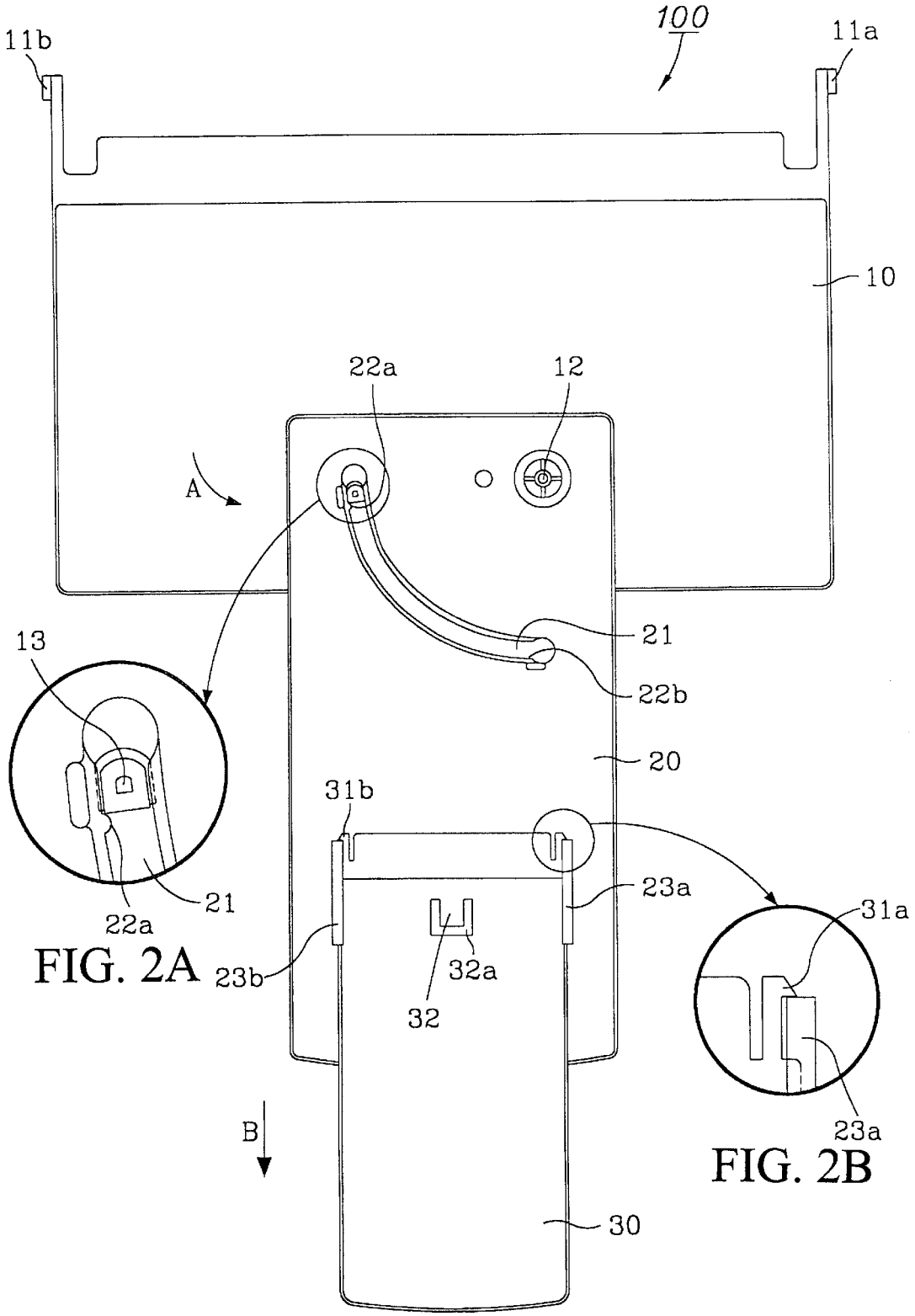
FIG. 2 is a plan view of the cassette of FIG. 1 with trays.

As shown in FIG. 2, second tray 20 is guided during its rotation by both rotating shaft 12 of the first tray and by plug 13 that is attached to the first tray and that is inserted in slot 21 of the second tray. Thus, the second tray 20 can be rotated around shaft 12 of the first tray in the direction that paper is ejected from the image forming device. As the contour of slot 21 is a curved line, second tray 20 can be rotated through 90° angle. When second tray 2O is rotated the sliding contact between slot 21 and plug 13 restricts the range through which second tray 20 rotates. Therefore, the maximum angle of rotation is 90 degrees.

A pair of bumps 22*a,* 22*b* are provided on the side of both ends of slot 21 to maintain the position of the second tray 20 when the second tray is fully extended or fully retracted the second tray is made of a flexible plastic material, and the position of the second tray is maintained by the engagement of plug 13 and bump 22*b* when the second tray is filly retracted when second tray 20 is fully extended, the second tray is held in position to by the engagement of tray 13 and bump 22*a* movement of second tray 20 can be controlled.

Pair of latches 31*a* and 31*b* are provided on both sides of the front end of the tray 30, in order to restrict the sliding movement of third tray 30 which can be slidably moved along a pair of guides 23*a,* 23*b* on the second tray. Third tray 30 is mounted on second tray 2O so that the third tray 20 can be slidably moved along guide rails, and the tray slides in the sheet discharging direction when the second sheet support 20 is fully extended.

Both sides of the front end of the third tray have a latch 31*a,* 3*b.* This prevents the third tray from being separated from guide rails 23*a,* 23*b* of the second tray when pulling the third tray into a extended position.

Figures 3, 3A, 3B:
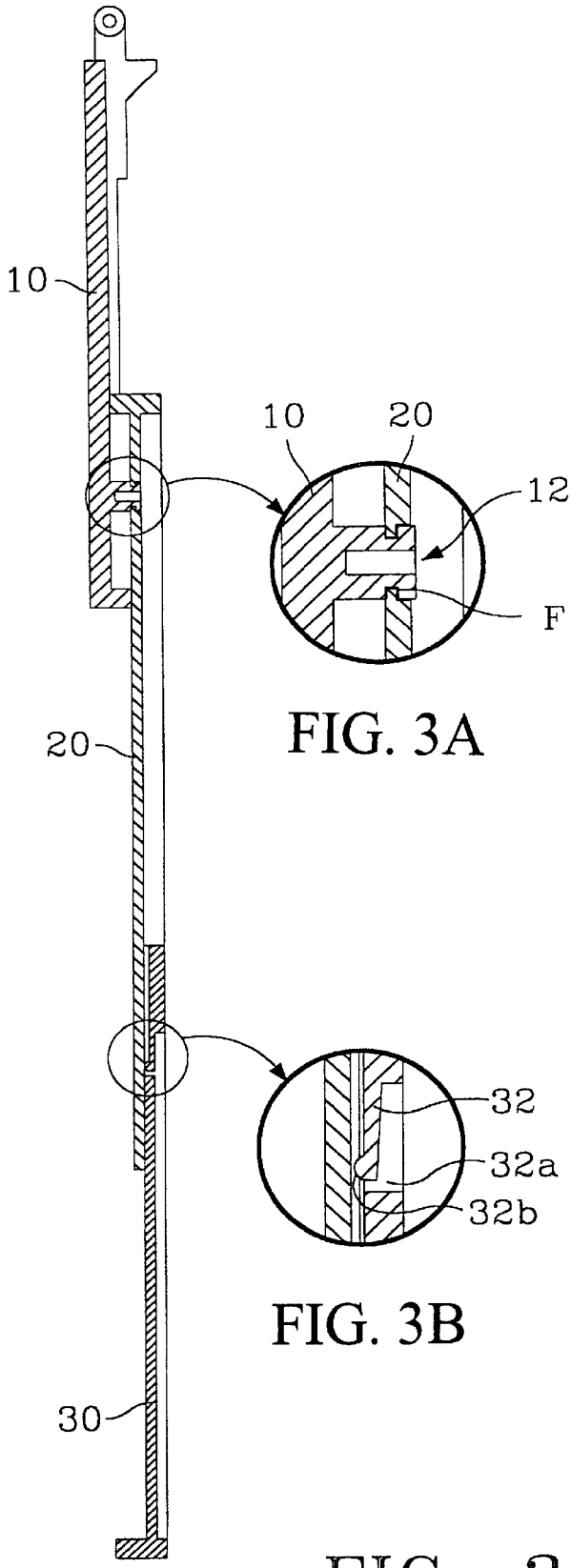
FIG. 3 is a sectional side view of the cassette of FIG. 1 in accordance with trays.

As shown in FIG. 3, flange 32 with abutment 32*b* provided on the lower side so that third tray 30 can be slidably moved back and forth smoothly on the second tray 30. A tension groove 32*a* is formed on the tension 32, which is formed so that flange 32 can be slanted slightly toward the lower side of third tray 30. Therefore, abutment 32*b* of flange 32 always comes into contact with the upper surface of the second tray so that the third tray is partially dumped during the sliding movement.

The operation of the cassette starts, first, with tray being on the image forming device. Then, as shown in FIG. 2, the second tray can be rotated around shaft 12 of the first tray in the direction of "A". After plug 13 is disengaged from bump 22*b* and slidably moved along slot 21 stops the movement of plug 13. Thus, if a user exerts a external force on the second tray in direction of "A", the second tray is prevented from continued relation.

Next, if the third tray is continuously pulled in the direction of "B", latches 31*a,* 31*b* of third tray 30 are engaged with tho ends of guide rails 23*a,* 23*b* to stop the sliding movement of the third tray.

Figure 4:
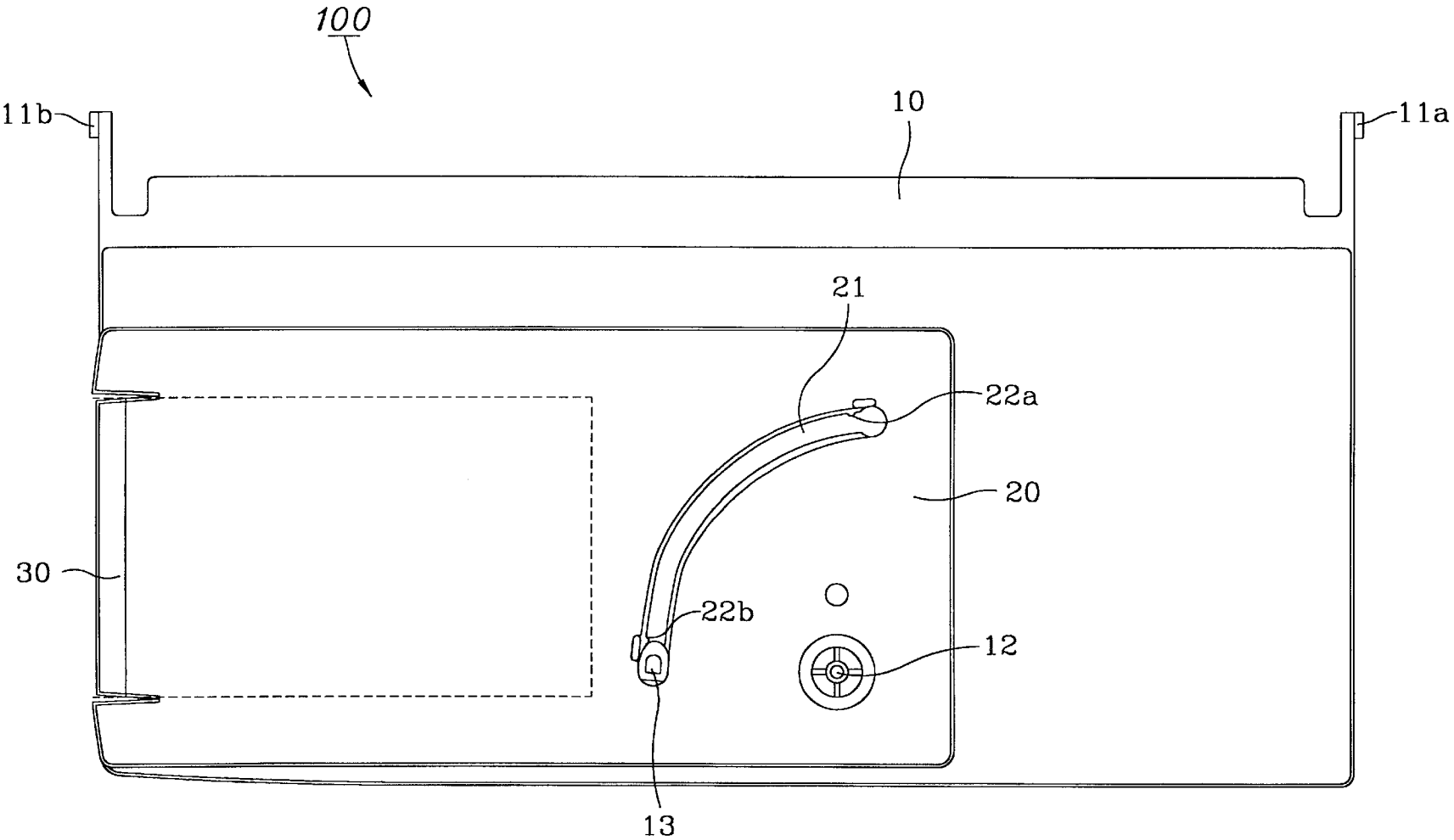

FIG. 4 gives a plan view of cassette for an image forming device according to a second embodiment of the present invention. Cassette 100 for an image may be constructed using first tray 10, second tray 20 and third 30. The second tray is mounted on the first tray so that second tray 20 can be rotated around shaft 12 of the first tray. The third tray is rotatably mounted to the lower side of second tray 20 so that the third 30 is extended and retracted. This is done via bracket 26 which permits the rotary movement of the third tray. Second tray 20 is mounted on the first tray in such a manner that it is rotatably extendable around shaft 12 of the first stacker 100.

Figures 5, 5A:
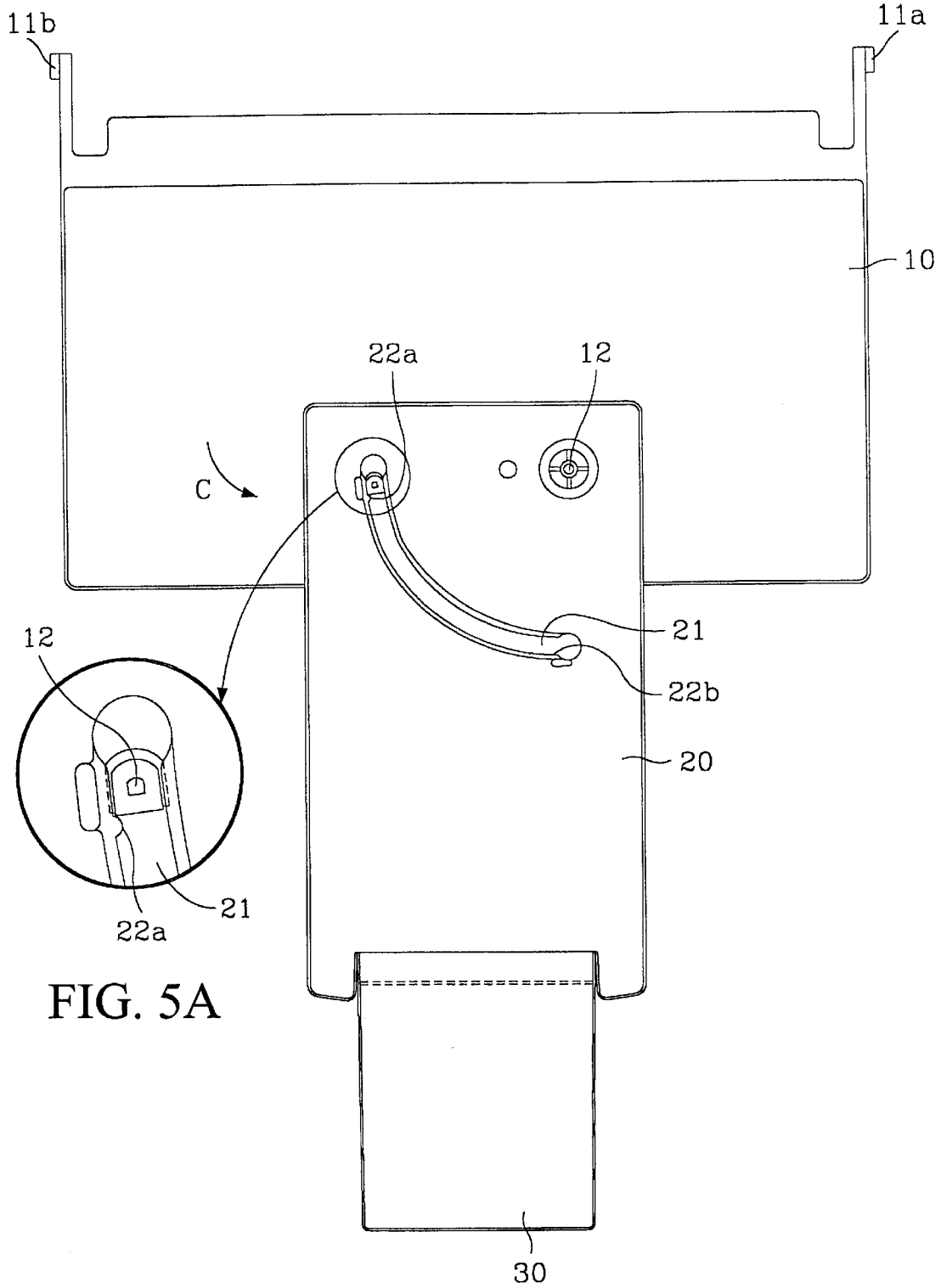
FIG. 5 is a plan view of the cassette of FIG. 4 with a plurality of trays unfolded.

As shown in FIG. 5, the second tray has slot 21 so that the second tray can be rotated around shaft 12 first tray 10. As the contour of slot 21 is curved line, to the second tray cam be rotated through a 90° angle. When the second tray is rotated into an extended position, the sliding contact of slot 21 and plug 13 of the first tray restricts the range through which the second tray rotates. Thus, the maximum angle of rotation is 90 degrees.

Bumps 22*a,* 22*b* are positioned on the side of both ends of slot 21 stabilizing the second tray in either a fully extended or a fully retracted position.

Bracket 26 may work with shaft 33. Hinge 33 is positioned in both sides of the front end of the third tray so that third tray 30 can be rotated in bracket 26 of the second tray. That is, the third sheet support 30 is mounted in the lower side of second tray so that the third tray can be rotated in bracket 26. This allows third tray 30 to be rotated into a extended position after second tray 20 is fully extended.

Figures 6, 6A, 6B:
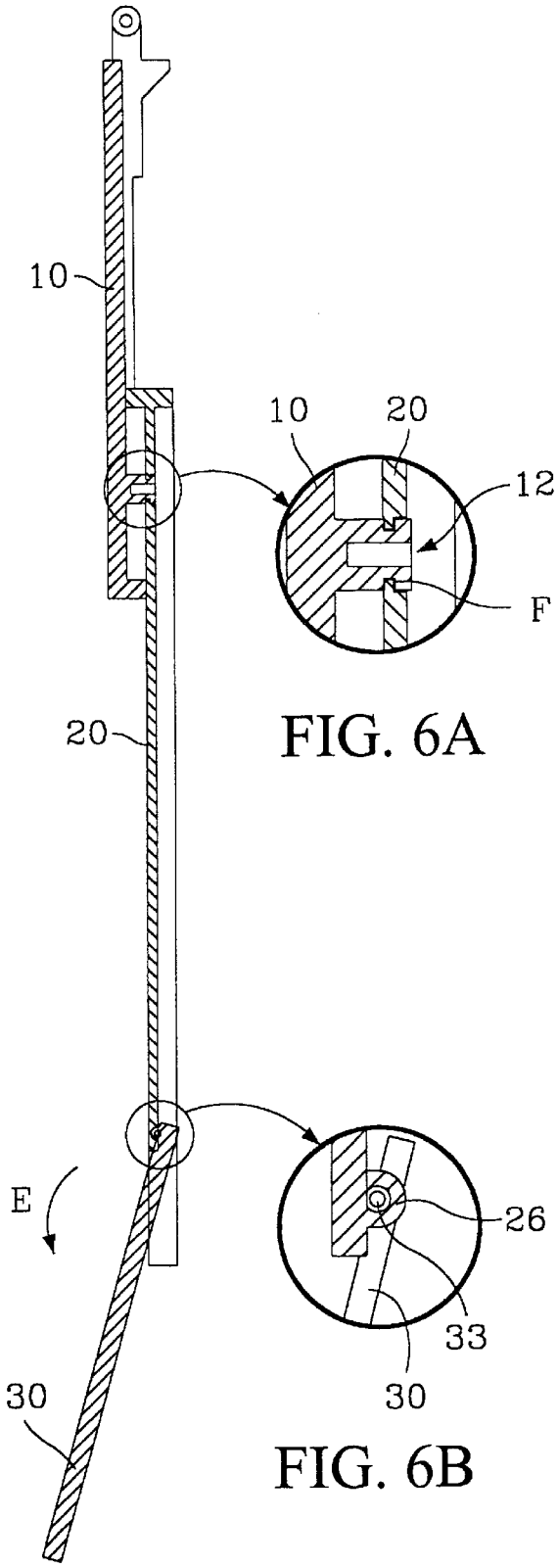
FIG. 6 is a sectional side view of the cassette of FIG. 4.

As shown in FIG. 6, hinge 33 of the third tray allows the to third tray to be rotated around bracket 26 of the second tray. By rotating the third sheet support 30 in the direction of "E" third tray can be fixed to the second tray. As described above, the present invention can be effectively used for the minimization of the size of the cassette needed for an image forming device.

While there have been illustrated and described what are considered to be preferred embodiments of the present invention, it will be understood by those skilled in the art that various changes and modifications and equivalents maybe substituted for elements thereof without departing from the true scope of the present invention. Therefore, it is intended that the present invention not to be limited to the particular embodiments disclosed as the best mode contemplated for carrying out the present invention, but that the present invention embraces all alternatives, modifications and variances falling within the scope of the appended claims.

*claim:*

1. A cassette for an electrophotographic apparatus, comprising:

a first tray engageable with said electrophotographic apparatus and having a first major surface, said first tray comprising:

a shaft protruding from said first major surface; and a plug protruding from said first major surface;

a second tray rotatably attached to said shaft of said first tray and having a second major surface, said second tray comprising:

a elongated slot for receivable engaging said plug of said first tray while accommodating rotation of said second tray relative to said first tray from a first position with said second major surface overlying said first major surface to a second position with said second major surface cantilevered beyond said first major surface; and a pair of guide rails disposed on said second major surface:

a third tray providing a third major surface slidably engaged with said pair of guide rails of said second tray to slidably position said third tray at varying distances from said electrophotographic apparatus; and said first tray, said second tray, and said third tray being mutually adjustable to support a stack of a plurality of cut sheets of a printable medium of any one of various sizes.

2. The cassette of claim 1, further comprised of said elongated slot in said second tray being curved to allow the parallel planar rotation of said second major surface relative to said first major surface through an angle of about 90 degrees.

3. The cassette of claim 2, further comprising a pair of latches on an end of said third tray restricting said third tray from being separated from said pair of guide rails of said second tray when said third tray is moved into an extended position.

4. The cassette of claim 3, further comprising a bump proximate to each end of said elongated slot in said second tray to engage said plug of said first tray to stabilize said second tray in either one of a fully extended position and a fully retracted position.

5. The cassette of claim 4, further comprising a flange attached to said third tray contacting said second major surface of said second tray to provide a damping force caused by the movement of said third tray relative to said second tray.

6. The cassette of claim 5, further comprised of an abutment attached to an end of said flange on said third tray to increase said damping force.

7. A cassette for an electrophotographic apparatus, comprising:

a first tray engageable with said electrophotographic apparatus and having a top side, said first tray comprising:

a shaft protruding from said top side; and a plug protruding from said top side;

a second tray rotatably attached to said shaft of said first tray and having a top surface, said second tray comprising:

a slot for receivably engaging said plug of said first tray, said slot being curved to allow the rotation of said second tray, through an angle of about 90 degrees, from a first position over said first tray to a second position with said second tray cantilevered over said first tray a bump proximate to each end of said slot disposed on an edge of said slot to engage said plug of said first tray to stabilize said second tray in either one of a fully extended position and a fully retracted position; and a pair of guide rails disposed on said top surface, a third tray slidably engaged with said pair of guide rails of said second tray: and said first tray, said second tray, and said third tray being adjustable to accommodate a stack of a plurality of cut sheets of a printable medium of any one of various sizes.

8. The cassette of claim 7, further comprising a pair of latches on an end of said third tray to prevent said third tray from being separated from said pair of guide rails of said second tray when said third tray is pulled into an extended position.

9. The cassette of claim 8, further comprising a flange attached to said third tray contacting said top surface of said second tray to provide a damping force.

10. The cassette of claim 9, further comprising an abutment attached to an end of said flange on said third tray to generate said damping force.

11. A cassette for an electrophotographic apparatus, comprising:

a first tray engageable with said electrophotographic apparatus and having a top side, said first tray comprising:

a shaft protruding from said top side; and a plug protruding from said top side;

a second tray rotatably attached to said shaft of said first tray and having a top surface, said second tray comprising:

a slot for receivably engaging said plug of said first tray, said slot being curved to allow the rotation of said second tray, through an angle of about 90 degrees, from a first position over said first tray to a second position with said second tray cantilevered over said first tray; and a bump proximate to each end of said slot disposed on an edge of said slot to engage said plug of said first tray to stabilize said second tray in either one of a fully extended position and a fully retracted position;

a third tray pivotally mounted on said second tray: and said first tray, said second tray, and said third tray being adjustable to accommodate a stack of a plurality of cut sheets of a printable medium of any one of various sizes.

12. The cassette of claim 11, further comprised by said third tray being rotatably storable under said second tray.

13. The cassette of claim 12, further comprised of said third tray being fixable to a lower side of said second tray.

14. The cassette of claim 13, further comprising said second tray having a pair of brackets attached to said lower side.

15. The cassette of claim 14, with said third tray further comprising a shaft for engaging said pair of brackets of said second tray.

* * * * *